US011309098B2

(12) United States Patent
Lee et al.

(10) Patent No.: US 11,309,098 B2
(45) Date of Patent: Apr. 19, 2022

(54) MINERALOGICAL METHOD AND APPARATUS FOR REMOVAL OF AQUEOUS CESIUM ION

(71) Applicant: KOREA ATOMIC ENERGY RESEARCH INSTITUTE, Daejeon (KR)

(72) Inventors: Seung Yeop Lee, Daejeon (KR); Hyo Jin Seo, Sejong (KR); Jae Kwang Lee, Daejeon (KR); Min Hoon Baik, Daejeon (KR)

(73) Assignee: KOREA ATOMIC ENERGY RESEARCH INSTITUTE, Daejeon (KR)

( * ) Notice: Subject to any disclaimer, the term of this patent is extended or adjusted under 35 U.S.C. 154(b) by 14 days.

(21) Appl. No.: 16/789,623

(22) Filed: Feb. 13, 2020

(65) Prior Publication Data

US 2020/0258646 A1 Aug. 13, 2020

(30) Foreign Application Priority Data

Feb. 13, 2019 (KR) ..... 10-2019-0016816

(51) Int. Cl.
*G21F 9/00* (2006.01)
*G21F 9/06* (2006.01)

(52) U.S. Cl.
CPC ..... *G21F 9/06* (2013.01)

(58) Field of Classification Search
CPC ..... G21F 9/06; C22B 26/10; C01D 17/003
See application file for complete search history.

(56) References Cited

U.S. PATENT DOCUMENTS 4,789,478 A * 12/1988 Revis ..... C02F 3/34 210/611
5,640,704 A 6/1997 Snyder et al.
(Continued)

FOREIGN PATENT DOCUMENTS

JP H0519096 A 1/1993
JP 2007-003270 A 1/2007
(Continued)

OTHER PUBLICATIONS

Firer, et al., "Control of sulfide in sewer systems by dosage of iron salts: Comparison between theoretical and experimental results, and practical implications," Science of The Total Environment, 392, 2008, pp. 145-156.

*Primary Examiner* — Steven J Bos
(74) *Attorney, Agent, or Firm* — Mintz Levin Cohn Ferris Glovsky and Popeo, P.C.; Peter F. Corless

(57) ABSTRACT

Mineralogical method and apparatus for removal of cesium ion in aqueous solution are provided. In particular, a mineralogical method for removal of cesium ion in aqueous solution including controlling a temperature of radioactive wastewater containing cesium from 25 to 45° C., controlling an initial pH of the radioactive wastewater from 6.0 to 8.5, and adding iron(II) and sulfide(−II) containing sulfur in the −2 oxidation state to the radioactive wastewater, to convert the cesium ion in aqueous solution into a cesium mineral, and a mineralogical apparatus for removal of cesium ion in aqueous solution, capable of being applied to such a method, are provided.

13 Claims, 7 Drawing Sheets

(56) References Cited

U.S. PATENT DOCUMENTS

| | | | | |
|---|---|---|---|---|
| 6,214,234 | B1 * | 4/2001 | Harjula | C01C 3/11 210/682 |
| 2015/0144038 | A1 * | 5/2015 | Tanaka | G21F 9/06 110/216 |
| 2015/0343436 | A1 | 12/2015 | Choi et al. | |
| 2018/0002210 | A1 | 1/2018 | Lee et al. | |

FOREIGN PATENT DOCUMENTS

| | | | |
|---|---|---|---|
| JP | 2013-217858 | A | 10/2013 |
| JP | 2014173924 | A | 9/2014 |
| JP | 2016044987 | A | 4/2016 |
| JP | 2018001151 | A | 1/2018 |
| KR | 10-2015-0137201 | A | 12/2015 |
| KR | 101754790 | B1 | 7/2017 |

* cited by examiner

MINERALOGICAL METHOD AND APPARATUS FOR REMOVAL OF AQUEOUS CESIUM ION

CROSS-REFERENCE TO RELATED APPLICATION

This application claims benefit of priority to Korean Patent Application No. 10-2019-0016816 filed on Feb. 13, 2019 in the Korean Intellectual Property Office, the disclosure of which is incorporated herein by reference in its entirety.

BACKGROUND

1. Field

The present disclosure relates to mineralogical method and apparatus for removal of cesium ion in aqueous solution, and more particularly, to mineralogical method and apparatus for removal of cesium ion in aqueous solution, having high radiation stability and advantageous post-underground disposal, by obtaining waste in a form of a mineral after processing radioactive wastewater.

2. Description of Related Art

Many technologies for processing radioactive wastewater are being developed both at domestically and abroad in relation to an operating nuclear power plant, dismantling of a nuclear power plant, decontamination, and the like. In the case of the operating nuclear power plant, relatively large amounts of radioactive wastewater may be discharged every day. Especially, major radioactive metal ions, for example, cobalt (Co), nickel (Ni), iron (Fe), or the like, in addition to cesium (Cs), may have a relatively long half-life and a relatively high level of radioactivity. Examples of radioactive nuclides mainly emitted in a case in which a severe accident occurs in a nuclear facility such as a nuclear power plant include Co-60, Cs-137, and the like. In particular, since Cs-137, radioactive cesium, has a relatively long half-life of about 30 years and relatively large amounts of emissions, a technology capable of highly efficiently removing or separating radioactive cesium in relatively large amounts is required.

Therefore, the processing and management of the nuclides, which are metal nuclides, are very important, but a main technology currently used in the field of operating the nuclear power plant is a technology of adsorbing the nuclides using an organic ion exchange resin. However, since an adsorption removal rate of the organic ion exchange resin is not particularly high, there may be a limit in processing relatively large amounts of radioactive wastewater. In particular, the biggest problem thereamong may be that relatively large amounts of radioactive waste may be generated and excessive costs for disposal of the radioactive waste using organic ion exchange resin on a relatively large scale may be required. Korean Patent Publication No. 10-2015-0137201 discloses a cesium adsorbent selectively adsorbing and separating cesium. In this case, there may be problems that, when using such an adsorbent, relatively large amounts of waste including the adsorbent may be generated, and when other dissolved ions such as $Na^+$, $Ca^{2+}$, or the like, are excessive therein, efficiency of an ion exchange resin may be rapidly deteriorated.

In the meantime, there may be problems that other adsorbents, in addition to an organic ion exchange resin, require excessive costs for industrial manufacturing and synthesis, and that adsorbed nuclides are then desorbed (eluted and vaporized) over time. Therefore, there is a need for a technology for removal of radioactive cesium leaked into freshwater or seawater, capable of lowering costs, increasing efficiency, and increasing stability.

Recently, a biomineral cesium removal method using microorganisms (Korean Patent Publication No. 10-2016-0084011) has been developed to significantly improve many problems of existing adsorbents. However, due to the characteristics of microorganisms, the reaction rate with cesium may be relatively slow and relatively large amounts of organic materials may be generated. Therefore, there is a need for an inorganic chemical processing technology that has relatively low costs and relatively high efficiency and does not generate such organic materials. Accordingly, it may be important to develop an inorganic mineralogy removal technology of cesium ions, capable of removing radioactive nuclides rapidly and eliminating the possibility of explosions due to the presence of organic materials in the post-processed waste, and it may be anticipated that these technologies will be widely used in relevant fields when provided to nuclear-related fields.

SUMMARY

An aspect of the present disclosure is to provide a mineralogical method for removal of cesium ion in aqueous solution.

Another aspect of the present disclosure is to provide a mineralogical apparatus for removal of cesium ion in aqueous solution.

According to an aspect of the present disclosure, a mineralogical method for removal of cesium ion in aqueous solution includes adding iron(II) and sulfide(−II) containing sulfur in the −2 oxidation state to radioactive wastewater containing cesium, to convert the cesium ion into a cesium mineral.

According to another aspect of the present disclosure, a mineralogical apparatus for removal of cesium ion in aqueous solution includes a control tank into which radioactive wastewater containing cesium is introduced, and a temperature of the radioactive wastewater is controlled to 25 to 45° C. and an initial pH of the radioactive wastewater is controlled to 6.0 to 8.5; and a reaction tank into which the radioactive wastewater discharged from the control tank is introduced, and to which iron(II) and sulfide(−II) containing sulfur in the −2 oxidation state are added.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
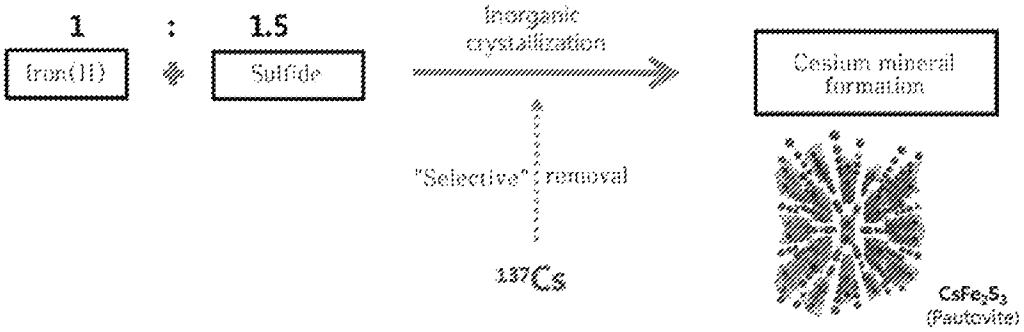
FIG. 1 is a schematic view illustrating an inorganic chemical process for forming a cesium mineral according to an embodiment of the present disclosure.

Hereinafter, embodiments of the present disclosure will be described as follows with reference to the attached drawings. However, embodiments of the present disclosure may be modified in various other forms, and the scope of the present disclosure is not limited to the embodiments described below.

The present disclosure relates to an inorganic chemical technology for removal of cesium by crystallization and mineralization of cesium ion in aqueous solution. Waste produced by the technology according to an embodiment of the present disclosure may not contain any organic components to be very stable to radioactive and high temperature environment to be processed, and relatively large amounts of radioactive nuclides including cesium may be rapidly removed in a relatively short period of time.

More specifically, the mineralogical method for removal of cesium ion in aqueous solution, according to an embodiment of the present disclosure, may include an operation of adding iron(II) and sulfide to radioactive wastewater containing the cesium ion.

The mineralogical method for removal of cesium ion in aqueous solution may be applied to the radioactive wastewater containing the cesium ion. An object to be processed is not particularly limited as long as the object is wastewater containing the cesium ion. For example, the object may be wastewater discharged from a nuclear facility such as a nuclear power plant.

Before the operation of adding the iron(II) and the sulfide, it is possible to perform a temperature and/or pH control operation of controlling a temperature and/or pH of the radioactive wastewater. More specifically, an operation of controlling a temperature of the radioactive wastewater from 25 to 45° C., before the operation of adding the iron(II) and the sulfide, an operation of controlling an initial pH of the radioactive wastewater from 6.0 to 8.5, before the operation of adding the iron(II) and the sulfide, or both thereof may be further included.

According to the mineralogical method for removal of cesium ion of the present disclosure, the temperature of the radioactive wastewater may be controlled to be 25 to 45° C., preferably 37 to 42° C., for example 40° C. When the temperature of the radioactive wastewater is less than 25° C., nucleation and crystal growth of the cesium ion may be not smoothly achieved. When the temperature of the radioactive wastewater exceeds 45° C., there may be problems that a rate of forming mineral therefrom is faster, but a rate of removing the cesium ion is lowered.

In the mineralogical method for removal of cesium ion according to an embodiment of the present disclosure, the mineral containing the cesium may be pautovite ($CsFe_2S_3$). As such, when the cesium is separated by the mineralogical method, there may be advantages that, since only the mineral containing the cesium may be removed as sludge without organic materials, a volume of the waste may be significantly reduced, and may be removed as a very stable inorganic crystal mineral to improve the stability for disposal.

In the mineralogical method for removal of cesium ion in aqueous solution according to an embodiment of the present disclosure, the initial pH of the radioactive wastewater may be controlled to be a weak alkali level, such as 6.0 to 8.5, preferably pH 7.7 to 8.2, for example pH 8. When the initial pH of the radioactive wastewater is less than 6.0, mineralization of the cesium ion may be not smoothly carried out. When the initial pH exceeds 8.5, there may be problems that relatively large amounts of fine particles are formed and suspended at the beginning of the reaction, and may be difficult to be precipitated to achieve a solid-liquid separation.

The operation of adding the iron(II) and the sulfide to the radioactive wastewater may be carried out, wherein the operation of adding the iron (II) and the sulfide may be carried out after the operations of controlling the temperature and pH.

The iron(II) in the operation of adding the iron(II) and the sulfide may be added at a concentration of 1 to 2 mM, for example, at a concentration of 1.2 to 1.8 mM. When the concentration of the iron(II) is less than 1 mM, there may be problems that nucleation and crystal growth of the cesium occur inadequately. When the concentration of the iron(II) exceeds 2 mM, there may be problems that efficiency for removal of the cesium slightly increases, but large amounts of iron and waste by-products are generated.

The iron (II) and the sulfide in the operation of adding the iron (II) and the sulfide may be preferably added in a molar ratio of sulfide 1:1 to 1:2, more preferably in a molar ratio of 1:1.3 to 1:1.7, and most preferably in a molar ratio of 1:1.5 based on 1 mol of the iron(II). When the sulfide is less than 1 mole based on 1 mol of the iron(II), there may be problems that an increase in the pH is relatively slow, residual iron ions increase after the iron(II) is added, and a cesium removal rate decreases. When the sulfide exceeds 2 moles based on 1 mole of the iron(II), there may be problems that the sulfide is present in the radioactive wastewater in excess to rapidly increase the pH to 10 or more, and the reaction rate increases to produce fine particles without sufficient growth of the cesium mineral. An amount of sulfide added in the operation of adding the iron (II) and the sulfide may be preferably added in an amount capable of increasing the pH of the radioactive wastewater to 10, such that the radioactive wastewater becomes an alkaline condition. For example, the iron(II) and the sulfide may be added in a molar ratio of 1:1 to 1:2 based on 1 mol of the iron(II), and more preferably, may be added until the pH reaches 10.

The iron(II) of the present disclosure may be at least one selected from the group consisting of iron chloride, iron sulfate, iron nitrate, iron carbonate, iron hydroxide, and iron formate, but is not limited thereto.

The sulfide of the present disclosure may include sulfur containing sulfur in the −2 oxidation state, and may be at least one selected from the group consisting of potassium sulfide, sodium sulfide, hydrogen sulfide, magnesium sulfide, and calcium sulfide, but is not limited thereto.

The mineralogical method for removal of cesium ion in aqueous solution of the present disclosure may further include adding a reducing agent to the radioactive wastewater in the operation of adding the iron(II) and the sulfide. Especially, when an amount of dissolved oxygen in the radioactive wastewater is relatively high, for example, 1 ppm or more, the reducing agent may be added to remove oxygen, and the reducing agent may be added to control the amount of dissolved oxygen to less than 1 ppm. When the amount of the dissolved oxygen in the radioactive wastewater is 1 ppm or more, the cesium removal rate may decrease.

The reducing agent may be at least one selected from the group consisting of sodium hydrosulfate, sodium thiosulfate, sodium thiosulfite, sodium hydrosulfite, hydrogen iodide, hydrogen bromide, hydrogen sulfide, lithium aluminum hydride, sodium borohydride, calcium borohydride, zinc borohydride, boron tetrahydride tetraalkyl ammonium, trichlorosilane, triethylsilane, carbon monoxide, sulfur dioxide, sodium sulfite, potassium sulfite, sodium bisulfite, sodium sulfide, sodium polysulfide, and ammonium sulfide, but is not limited thereto.

In this case, the reducing agent may be added in an amount of 50 to 500 g per 1 ton of the radioactive wastewater, for example, may be added in an amount of 100 to 200 g per 1 ton of the radioactive wastewater. When an amount of the reducing agent is lower than the above range, intended removal of oxygen may be insufficient. When an amount of the reducing agent exceeds the above range, there may be problems the sulfate and hydrogen excessively occur.

The mineralogical method for removal of cesium ion in aqueous solution of the present disclosure may include adding carbonate ($NaHCO_3$) to the radioactive wastewater. The operation of adding the carbonate may be carried out simultaneously with or separately from, for example, before or after the operation of adding the iron(II) and the sulfide. In the operation of adding the iron(II) and the sulfide, the addition of sulfide may produce a reactive hydrogen sulfide ion ($HS^-$) and may consume a hydrogen ion ($H^+$) in the radioactive wastewater to increase the pH thereof. When the radioactive wastewater does not reach specific alkali conditions (e.g., a pH of 10), the operation of adding the carbonate may be further included. The addition of the carbonate may promote and stabilize the growth of cesium mineral.

When the carbonate ($NaHCO_3$) is added, the pH may gradually increase from an initial pH. The operation of adding the carbonate may be performed toward a pH of 10 or less. When the pH exceeds 10, an acid may be added to control the pH to 10 or less, for example, 10. When carbonic acid is added, the cesium mineral may be stabilized, and the crystal growth process may be continued to facilitate the solid-liquid separation, to improve efficiency for removal of the nuclide. When the operation of adding the carbonate is performed in excess of a pH of 10, a cesium removal rate may be lowered.

The addition of the carbonic acid may be performed at a concentration of 3 to 7 mM, for example, at a concentration of 2 to 8 mM, preferably at a concentration of 4 to 6 mM.

An acid may be added to control the pH in the operation of adding the carbonate. A type of the acid is not particularly limited, but an inorganic acid such as nitric acid, hydrochloric acid, sulfuric acid, phosphoric acid, acetic acid, perchloric acid, hypochlorous acid, hydrofluoric acid, or a combination thereof may be used.

The mineralogical method for removal of cesium ion in aqueous solution according to an embodiment of the present disclosure may be carried out at an agitation speed of 50 to 200 rpm by impeller rotation, in terms of reducing chemical reaction of the cesium ion and excessive physical collision of growing particles, may be carried out more preferably, at an agitation speed of 70 to 150 rpm, and may be carried out, most preferably, for example, at an agitation speed of 100 rpm. In particular, in the operation of adding the reagent of the present disclosure, it is preferable that the agitation is involved and the agitation speed is maintained at a constant chemical reaction. There is a problem that a growing crystal of cesium mineral may be broken when the agitation speed is changed in the operation. When the agitation speed is less than 50 rpm, there may be problems that the chemical reaction and nucleation of the cesium mineral are relatively poor, and crystallization of the cesium may not be smoothly performed. When the agitation speed is higher than 200 rpm, the growing cesium mineral may become fine, may be not precipitated, and may be suspended for a relatively long period of time. Therefore, there may be problems that it difficult to perform the final solid-liquid separation to significantly deteriorate removal of the cesium.

The mineralogical method for removal of cesium ion in aqueous solution according to an embodiment of the present disclosure may remove most of the cesium, when carried out in a batch process for 12 to 48 hours, preferably for 18 to 24 hours. For example, the mineralogical method may obtain a cesium removal rate of at least 98% when carried out in a batch process within 24 hours.

According to another aspect of the present disclosure, there may be provided a mineralogical apparatus for removal of cesium ion in aqueous solution that may be applied to the mineralogical method for removal of cesium ion in aqueous solution according to an embodiment of the present disclosure, described above.

The mineralogical apparatus for removal of cesium ion in aqueous solution according to an embodiment of the present disclosure may include a control tank into which radioactive wastewater containing cesium is introduced, and a temperature of the introduced radioactive wastewater is controlled to 25 to 45° C. and an initial pH of the introduced radioactive wastewater is controlled from 6.0 to 8.5; and a reaction tank into which the radioactive wastewater discharged from the control tank is introduced, and to which iron(II) and sulfide are added.

In mineralogical apparatus for removal of cesium ion in aqueous solution according to an embodiment of the present disclosure, the contents related to mineralogical processes for removal of cesium ion in aqueous solution may be the same as described above in connection with the mineralogical method for removal of cesium ion in aqueous solution.

In the control tank, after the radioactive wastewater is introduced, the operations of controlling the temperature and pH may be performed. For this purpose, the control tank may include a temperature sensor, a pH sensor, a temperature controller linked to the temperature sensor and the pH sensor and capable of increasing and lowering the temperature, and a pH controller capable of adding an acid or a base to the control tank according to the pH sensor. The specific kind of such controllers is not particularly limited. The control tank may be a sealed structure in which air is blocked.

The radioactive wastewater in which the temperature and pH are controlled in the control tank may be transferred to the reaction tank, and the reaction tank may receive the radioactive wastewater discharged from the control tank, to achieve the addition of iron(II) and sulfide. Furthermore, a carbonate, a reducing agent, or a combination thereof may be further added to the reaction tank. The possibility of directly adding the carbonate, the reducing agent, or a combination thereof into the control tank may be not excluded, and in this case, the control tank and the reaction tank may be integrated.

The reaction tank may be stirred at 50 to 200 rpm, and an agitator for performing the agitation is not particularly limited, and may include, for example, an impeller, a blade, or the like.

Furthermore, the mineralogical apparatus for removal of cesium ion in aqueous solution according to an embodiment of the present disclosure may further include a solid-liquid separator separating slurry of cesium mineral particles produced in the reaction tank. In this case, the kind of the solid-liquid separator is not particularly limited, and may be, for example, a centrifugal separator, a filter, a dehydrator, a dryer, or the like.

According to the mineralogical method and apparatus for removal of cesium ion in aqueous solution of the present disclosure may remove at least 98% of major metal nuclides such as cobalt, nickel, iron, or the like as well as cesium simultaneously, within 24 hours. While excellent solid-liquid separation efficiency may be obtained, the amount of radioactive waste may be significantly reduced, in a different manner to conventionally expensive and waste-generating organic resins. Furthermore, it may be easy to manage post waste due to the inorganic minerals, and may achieve increased long-term stability in disposal of waste.

Hereinafter, the present disclosure will be described in more detail with reference to specific examples. The following examples are merely examples to help in an understanding of the present disclosure, but the scope of the present disclosure is not limited thereto.

EXAMPLES

1. Mineralogical Method for Removal of Cesium Ion

Wastewater containing nuclides were purified by the following process of the present disclosure, without using an adsorbent such as an expensive organic ion exchange resin.

Figure 2:
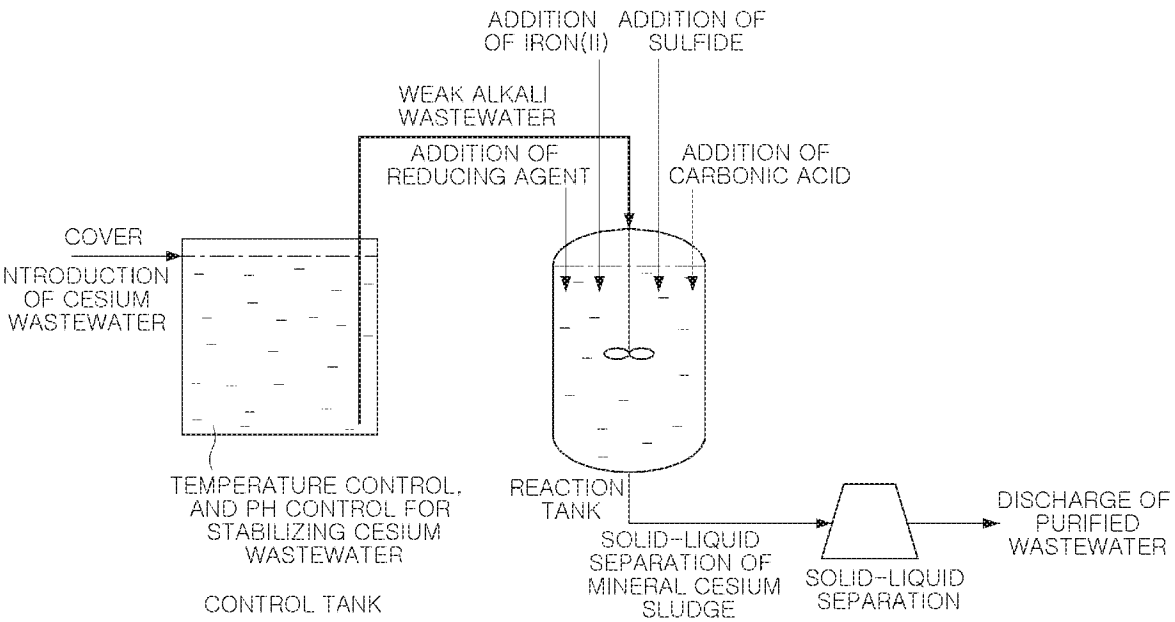
FIG. 2 is a schematic view illustrating a mineralogical apparatus for removal of cesium ion in aqueous solution according to an embodiment of the present disclosure.

For purification of the wastewater, as illustrated in FIG. 2, an apparatus including a control tank for the wastewater, a reaction tank for the wastewater, and a centrifugal separator for solid-liquid separation was prepared. The wastewater containing the nuclides at room temperature was introduced into the reaction tank, and a temperature of the wastewater was raised to 40° C. (±5° C.) through a thermostat installed in the reaction tank. In this case, the wastewater was prepared to include 0.1 ppm cesium, 1.0 ppm cobalt, 1.0 ppm iron, and 1.0 ppm nickel. In addition, an initial pH of the wastewater was adjusted to 8.0 (±0.5) by a pH meter installed in the reaction tank. In order to control the pH of the wastewater, a storage tank for supplying HCl or a NaOH reagent was further installed, and the pH was controlled by adding the reagent as needed. As such, the wastewater to which the temperature and pH of the wastewater in the control tank for the wastewater were adjusted was transferred to the reaction tank by a pump.

In the control tank for the wastewater, a storage tank for supplying a reducing agent, a storage tank for supplying iron(II), and a storage tank for supplying sulfide were installed, respectively, sodium sulfite, the reducing agent, was added in an amount of about 500 g based on 5 tons of the wastewater, iron(II) was added in a concentration of about 1.5 mM, and sulfide was added in an initial concentration of about 2.25 mM. In this case, a ratio of the iron(II) and sulfide to be added was 1:1.5, and the pH of the wastewater gradually increased to 10, as reactive hydrogen sulfide ions ($HS^-$) were formed and hydrogen ions ($H^+$) were consumed. In addition, a storage tank for supplying carbonic acid was installed to enhance nuclide crystal formation and stability, and about 5 mM of the total amount of the carbonic acid was gradually added toward a pH of 10 or less. For chemical reactions of dissolved reagents and smooth growth of crystals in the reaction tank, an impeller and a blade were installed in the reaction tank, and an agitation speed was set to be about 100 rpm. In the reaction tank in a reduced state, reactive hydrogen sulfide ions ($HS^-$) and sulfide ions ($S^{2-}$) were coupled with iron ions ($Fe^{2+}$) over time, and, in this case, selectively attracted $Cs^+$ in water to form cesium mineral particles and precipitate the same. In addition, the remaining major metal nuclides (Co, Ni, and Fe) were also coupled with extra hydrogen sulfide and sulfide ions, to be co-precipitated with the cesium mineral particles, with formation of respective metal sulfide crystals. In order to increase the initial reaction rate of the nuclides in the wastewater reaction tank, it was initially set to a weak alkali (pH 8.0) condition, and the hot water (40° C.) state was maintained. In addition, iron(II), sulfide, and carbonate were sequentially added to stabilize the mineral cesium at a pH of 10.0 or less and to continue growth of the crystals. Finally, the efficiency for removal of nuclides was improved by making solid-liquid separation easier.

When the reducible chemical reaction and crystal growth of the nuclides were completed, the wastewater was sent to an industrial centrifugal separator to separate solids and liquid, purified wastewater was discharged, and precipitated mineral sludge was collected for final disposal.

2. Confirmation of Nuclide Removal Effect

In order to confirm the nuclide removal effect by the inorganic chemical process as described in Section 1 above, after the initial concentration of cesium, cobalt, iron, and nickel were measured, the mineralogical method for removal of cesium ion in aqueous solution according to an embodiment of the present disclosure was carried out. Thereafter, after 24 hours, the final concentration of each nuclide was measured and confirmed.

Figure 3:
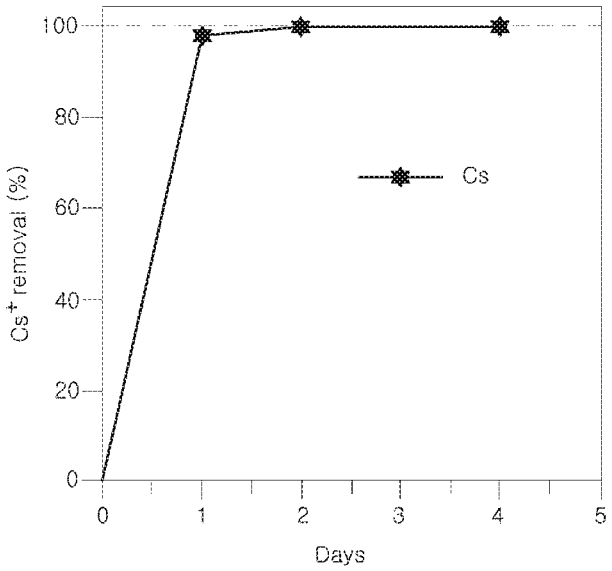
FIG. 3 illustrates a cesium ion removal rate according to an embodiment of the present disclosure over time.
Figure 4:
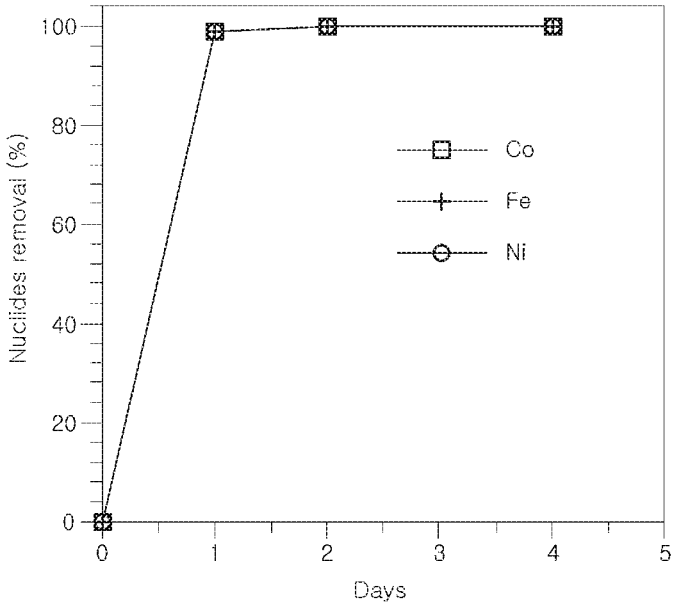
FIG. 4 illustrates another nuclide removal rate according to an embodiment of the present disclosure over time.

The results therefrom can be seen in FIGS. 3 and 4, and in the case of cesium, it was found that the removal rate thereof reached 98%, ranging from 0.1 ppm of the initial concentration to 0.002 ppm after 24 hours. In addition, in the cases of cobalt, iron, and nickel, respectively, it was found that the removal rate thereof >99%, ranging from 1.0 ppm of the initial concentration to <: 0.01 ppm or less after 24 hours.

Thus, the mineralogical method for removal of cesium ion in aqueous solution of the present disclosure, it was possible to quickly remove a large amount of cesium and other nuclides.

3. Identification of Generated Inorganic Cesium Mineral

In order to identify the cesium mineral (pautovite) in the inorganic form obtained as a result of performing Section 1 above, the cesium crystal was identified and main chemical components were analyzed by using a scanning electron microscope.

Figure 5A:
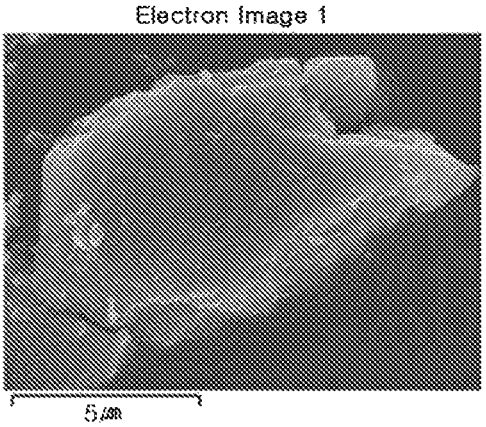
FIG. 5A is an image of cesium mineral (pautovite) precipitated in a form of an inorganic crystal, captured by scanning electron microscopy.

As a result, as shown in FIG. 5A, a final product of the cesium was determined to be a crystalline mineral form through the scanning electron microscopy. From the analysis spectrum of FIG. 5B, it can be seen that the Cs was included in an amount of about 0.5 wt %. From the elemental mapping result of FIG. 5C, it can be seen that the Cs element was associated with Fe and S, forming the mineral as a pautovite.

Figure 5B:
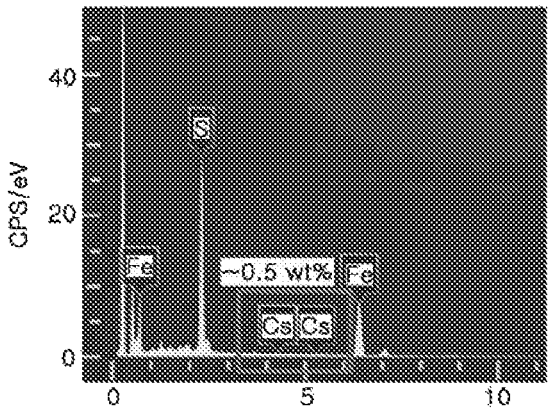
FIGS. 5B and 5C illustrate that cesium (Cs) is fixed and mineralized in a crystal, mainly containing iron (Fe) and sulfur (S), in an amount of about 0.5 wt %, to be stable.
Figure 5C:
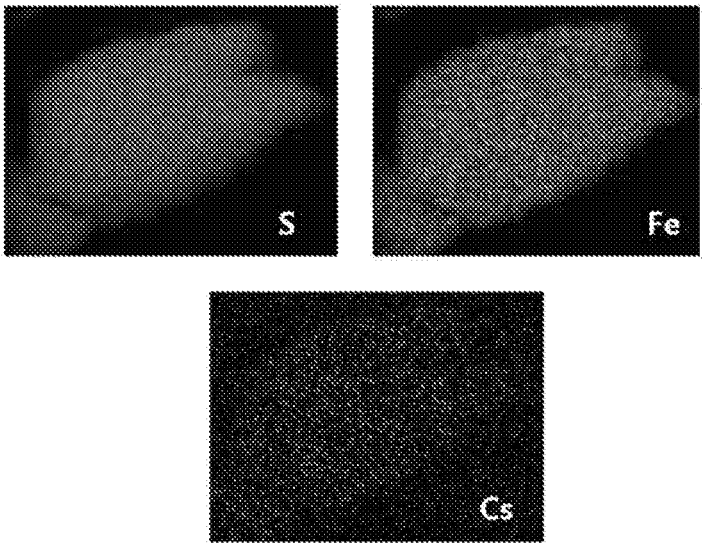

As can be seen in FIGS. 5A to 5C, the cesium mineral (pautovite) obtained by the mineralogical method and apparatus for removal of cesium ion in aqueous solution according to an embodiment of the present disclosure had not only a rapid progress of mineralization, but also a large crystal size, generally, having more than 5 μm. Therefore, according to an embodiment of the present disclosure, precipitation may occur well, solid-liquid separation may be facilitated, long-term stability may be improved, and ultimately, high cesium and nuclide removal efficiencies may be achieved.

The inorganic chemical technology for removal of cesium (Cs) by the mineralization of the cesium (Cs) according to an embodiment of the present disclosure may remove most of the major nuclides as well as cesium in a relatively short time by a large-volume batch manner, and, therefore, since there may be no organic material in the post-processed waste, it may be very stable under the radioactive and high temperature environment, may be easy to manage the post waste, and may achieve increased stability for disposal.

While example embodiments have been shown and described above, it will be apparent to those skilled in the art that modifications and variations could be made without departing from the scope of the present disclosure as defined by the appended claims.

What is claimed is:

1. A mineralogical method for removal of cesium ion, comprising adding iron(II) and sulfide(−II) containing sulfur in the −2 oxidation state to radioactive wastewater containing cesium, to convert the cesium ion into a cesium mineral, wherein the iron(II) and the sulfide(−II) in the adding of the iron(II) and the sulfide(−II) are added in a molar ratio of 1:1 to 1:2 based on 1 mol of the iron(II).

2. The mineralogical method according to claim 1, wherein the cesium mineral is pautovite ($CsFe_2S_3$).

3. The mineralogical method according to claim 1, further comprising controlling a temperature of the radioactive wastewater from 25 to 45° C., before the adding of the iron(II) and the sulfide(−II).

4. The mineralogical method according to claim 1, further comprising controlling an initial pH of the radioactive wastewater from 6.0 to 8.5, before the adding of the iron(II) and the sulfide(−II).

5. The mineralogical method according to claim 1, wherein the iron(II) in the adding of the iron(II) and the sulfide(−II) is added at a concentration of 1 to 2 mM.

6. The mineralogical method according to claim 1, wherein an amount of the sulfide(−II) introduced in the adding of the iron(II) and the sulfide(−II) is controlled to increase pH of the radioactive wastewater to 10.

7. The mineralogical method according to claim 1, wherein the iron(II) is at least one selected from the iron(II) reagent group consisting of iron chloride, iron sulfate, iron nitrate, iron carbonate, iron hydroxide, and iron formate.

8. The mineralogical method according to claim 1, wherein the sulfide(−II) is at least one selected from the sulfide (−II) reagent group consisting of potassium sulfide, sodium sulfide, hydrogen sulfide, magnesium sulfide, and calcium sulfide.

9. The mineralogical method according to claim 1, further comprising adding a reducing agent to the radioactive wastewater in the adding of the iron(II) and the sulfide(−II).

10. The mineralogical method according to claim 9, wherein the reducing agent is added in an amount of 50 to 500 g per 1 ton of the radioactive wastewater.

11. The mineralogical method according to claim 1, further comprising adding carbonate to the radioactive wastewater.

12. The mineralogical method according to claim 11, wherein the adding of the carbonate is carried out at a pH of 10 or less.

13. The mineralogical method according to claim 11, wherein the adding of the carbonate is carried out simultaneously with or separately from the adding of the iron(II) and the sulfide(−II).

* * * * *